US006618426B1

(12) United States Patent
Ernst

(10) Patent No.: US 6,618,426 B1
(45) Date of Patent: Sep. 9, 2003

(54) ELECTROMAGNETIC STIRRING OF A MELTING METAL

(75) Inventor: Roland Ernst, Gieres (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 09/913,899

(22) PCT Filed: Feb. 25, 2000

(86) PCT No.: PCT/FR00/00476

§ 371 (c)(1),
(2), (4) Date: Dec. 3, 2001

(87) PCT Pub. No.: WO00/51400

PCT Pub. Date: Aug. 31, 2000

(30) Foreign Application Priority Data

Feb. 26, 1999 (FR) ..... 99 02655

(51) Int. Cl.[7] ..... H05B 6/34; H05B 6/36
(52) U.S. Cl. ..... 373/146; 373/152
(58) Field of Search ..... 373/138, 139, 373/146, 147, 148, 150, 152, 153, 59, 7; 219/635, 647, 648, 672, 674; 75/10.13; 266/234

(56) References Cited

U.S. PATENT DOCUMENTS

| | | | | | |
|---|---|---|---|---|---|
| 1,330,133 | A | | 2/1920 | Northrup | |
| 1,378,187 | A | | 5/1921 | Northrup | |
| 1,822,539 | A | * | 9/1931 | Northrup | 373/146 |
| 1,986,353 | A | | 1/1935 | Northrup | |
| 3,314,670 | A | * | 4/1967 | Kennedy | 373/146 |
| 3,478,156 | A | * | 11/1969 | Segsworth | 373/146 |
| 4,238,637 | A | * | 12/1980 | Bingen et al. | 373/146 |
| 5,889,812 | A | * | 3/1999 | Schluckebier | 373/149 |
| 2002/0122456 | A1 | * | 9/2002 | Fishman et al. | 373/150 |

FOREIGN PATENT DOCUMENTS

| | | |
|---|---|---|
| FR | 713498 | 11/1931 |
| FR | 1270387 | 1/1962 |

* cited by examiner

*Primary Examiner*—Tu Ba Hoang
(74) *Attorney, Agent, or Firm*—Duane Morris LLP

(57) ABSTRACT

An installation for processing by induction a metallic material is disclosed. The installation includes a first winding including, in series, at least one first coil of at least one turn and at least one second coil of at least one turn, wound in opposite directions around a container, the first winding having two end terminals connected to an A.C. supply source and across at first capacitor, and at least one second winding including, in series, at least one first coil of at least one turn and at least one second coil of at least one turn, wound in opposite directions around the container by being imbricated in the first winding, wherein the ends of the second winding being connected across a second capacitor (C').

7 Claims, 2 Drawing Sheets

ELECTROMAGNETIC STIRRING OF A MELTING METAL

BACKGROUND OF THE INVENTION

1. Field of the Invention

The present invention relates to installations of induction processing of molten metallic materials, for example for stirring, motion organization, and/or metallic material formation. The present invention more specifically relates to such installations using an inductive crucible and, among these, installations in which the crucible is intended not only for organizing the induction stirring of a molten metal, but also for heating up this metal by induction. The present invention applies to such inductive crucible installations, be they continuous casting installations or not.

2. Description of Related Art

The present invention will be described hereafter in relation with a cold inductive crucible, but it should be noted that it more generally applies to any other installation in which molten metal is in a magnetic field. Among inductive crucible installations, a cold crucible is often preferred to a crucible made of a refractory material when the metallic material to be elaborated requires a high degree of purity, since a cold crucible minimizes the contamination of the processed material.

FIG. 1 schematically shows a conventional installation for the formation of a metallic material by induction in a cold inductive crucible.

Such an installation includes a crucible 1 cooled down by circulation of water inside its wall, and intended for containing the material to be molten. In FIG. 1, the details constitutive of the crucible walls have not been shown for clarity. In particular, the means of circulation of the cooling liquid in the wall thickness have not been illustrated.

An inductor, generally a winding 2, surrounds crucible 1 and is connected, by its two ends, across a single-phase A.C. voltage generator 3. A capacitor C is connected in parallel on generator 3, that is, across winding 2.

The metallic material to be molten in the crucible is introduced therein, for example, in the form of chips m. In the case of a continuous casting crucible, chips m are continuously introduced, generally via a spout 4.

The magnetic field caused by inductor 2 heats up the material contained in crucible 1. The frequency of the A.C. excitation circuit of inductor 2 especially depends on the diameter of crucible 1 and on the electric resistivity of the material contained therein. As known, the electric resistivity of the material and the excitation frequency of inductor 2 condition the electromagnetic skin depth ($\delta$). The desired skin depth depends on the applications. For example, in the case of an ingot mould, the desired skin depth is the smallest possible while being sufficient to avoiding adversely affecting the thermal yield in view of the cold crucible walls. As a specific example, for a crucible having a diameter on the order of 10 centimeters, it is generally desired to have an electromagnetic skin depth on the order of from 1 to 10 millimeters.

It should be noted that, although this has not been shown in FIG. 1, a cold crucible is a sectorized crucible, that is, a crucible provided with vertical sectors isolated from one another to avoid a looping of the induced currents on the crucible periphery. As illustrated in FIG. 1, in a crucible supplied by a single-phase generator, the free surface of the metal melt appears in the form of a liquid dome, the profile of which results from the balance between the hydrostatic pressure and the electromagnetic pressure coming from single-phase inductor 2. Further, on this free surface, there exists an electromagnetic stirring force which is a force with an always centrifugal radial component at the melt surface, as illustrated by the arrows in FIG. 1. Thus, chips m coming from supply system 4 and falling by gravity into the melt are systematically, at their arrival, driven from the center to the periphery, and thus towards the cold walls of crucible 1.

Such a circulation is unfavorable to the thermal yield of the system and to the ingestion of chips m in the melt. This may even affect the surface state of the solidified ingot obtained by continuous casting in the lower portion (not shown) of crucible 1.

It would be desirable to invert the stirring direction at the melt surface so that the chips of the material to be melted are driven towards the center of the melt, and thus improve the mixing. For this purpose, it can be devised to form, around the crucible, a system of multiphase inductors creating a drift magnetic field, generating an ascending electromagnetic force in the thickness of the electromagnetic skin, and thus at the crucible periphery. This force then results in having the liquid-metal of the melt rise at the periphery in the thickness of the electromagnetic skin, and by conservation of the flow rate, having the liquid metal fall at the center of the melt. A centripetal radial electromagnetic stirring force is thus obtained, which is propitious to the driving of the supply chips, at their arrival on the melt, no longer towards the periphery, but conversely towards the center of the melt where they are immediately ingested and molten.

However, the implementation of such a principle poses several problems which have caused, up to now, that this solution is not industrially viable in practice.

A first problem is due to the need to have a multiphase induction generator, and thus two voltage generators shifted in phase with respect to each other.

For an installation in which the crucible has a sufficiently large diameter (on the order of thirty centimeters) enabling its supply by a generator operating on the frequency of the A.C. electric network (50 or 60 hertz), it is necessary to have a multiphase power supply (di- or triphasic) to implement this principle of inversion of the melt stirring direction. Thus, this prevents the simple connection of the installation on a single-phase electric power supply.

A similar problem arises in other cases, for example, the duct of relatively small diameter of an electromagnetic pump.

The problem is increased for induction generators of medium frequency (on the order of ten kilohertz) for which it is necessary to have an electronic power circuit to form the generator ((3, FIG. 1) to supply inductor 2 with a current of frequency different from the distribution frequency.

In such applications, which more specifically relate to crucibles or containers of small diameter, it would then be necessary to have an electronic power circuit for each phase, which considerably increases the installation cost. In particular, this requires the multiplication of the number of power components in accordance with the number of phases. Further, the synchronization of the generators with the phase of the A. C. power supply provided by the distribution network is made all the more difficult as the frequency of the induction generator and the number of phases are high.

SUMMARY OF THE INVENTION

The present invention aims at overcoming the disadvantages of conventional installations with an inductive crucible. The present invention aims, in particular, at providing a novel installation enabling the stirring of the molten metal melt, at will, in a centripetal direction or in a centrifugal direction.

More generally, the present invention aims at providing a novel solution to problems of stirring by induction in molten metal containers.

The present invention also aims at providing a novel solution for performing a multiphase generation which is economically viable. The present invention aims, in particular, at providing a solution that does not require multiplication of the power switches for applications requiring a medium-frequency induction.

The present invention also aims at providing a solution that can be supplied from a single-phase electromagnetic source.

The present invention further aims at providing a solution that poses no problem of synchronization of the different phases with respect to one another.

To achieve these objects, the present invention provides an installation for processing by induction a metallic material in a container, including:

a first winding including, in series, at least one first coil of at least one turn and at least one second coil of at least one turn, wound in opposite directions around the container, the first winding having two end terminals intended for being connected to an A.C. supply source and across a first capacitor; and at least one second winding including, in series, at least one first coil of at least one turn and at least one second coil of at least one turn, wound in opposite directions around the container by being imbricated in the first winding, the ends of the second winding being intended for being connected across a second capacitor.

According to an embodiment of the present invention, the capacitances depend on the generator frequency and on the desired skin depth inside the container.

According to an embodiment of the present invention, applied to a inductive heating installation in an inductive crucible forming said container, the combined inductances of the two windings are a function of the heating intensity desired inside of the crucible.

BRIEF DESCRIPTION OF THE FIGURES

According to an embodiment of the present invention, the installation further includes at least one third winding, the terminals of which are connected to a third capacitor, the third winding being formed of at least two coils associated in series-opposition.

The foregoing objects, features and advantages of the present invention will be discussed in detail in the following non-limiting description of specific embodiments in connection with the accompanying drawings, among which.

DETAILED DESCRIPTION OF THE INVENTION

Figure 1:
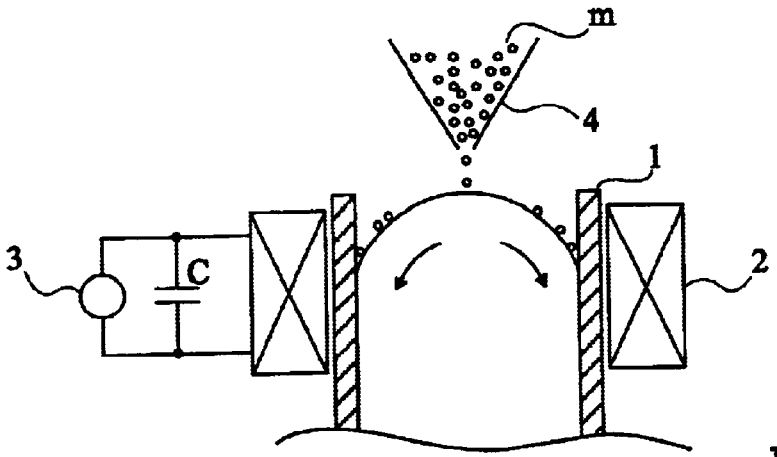
Fig 1 PRIOR ART
FIG. 1, previously described, is intended for showing the state of the art and the problem to solve.

The same elements have been designated by the same references in the different drawings. For clarity, only those elements of an inductive heating installation which are necessary to the understanding of the present invention have been shown in the drawings and will be described hereafter. In particular, the means of discharge of the liquid metal (for example, the ingot drawing means) have not been shown and are not the object of the present invention. On this regard, it should be noted that the present invention applies to a crucible (cold or refractory) of an ingot mould as well as to a crucible intended for being emptied by tipping over. More generally, it should be noted that the present invention can be implemented in any installation using an inductive means around a molten metal container, for organizing the metal motions. This may be, for example, electromagnetic stirrers (in which the metal is heated by induction, by arc, by means of a plasma torch, or other), electromagnetic pumps, and more generally any installation in which problems due to the diameter of the container (-crucible, duct, etc.) are posed.

A feature of the present invention is to provide, around a molten metal container, at least two windings each formed of two coils in series-opposition, a single one of the windings being connected across a single-phase generator. The other winding(s) form induced or secondary windings by being closed through a capacitor.

Figure 2:
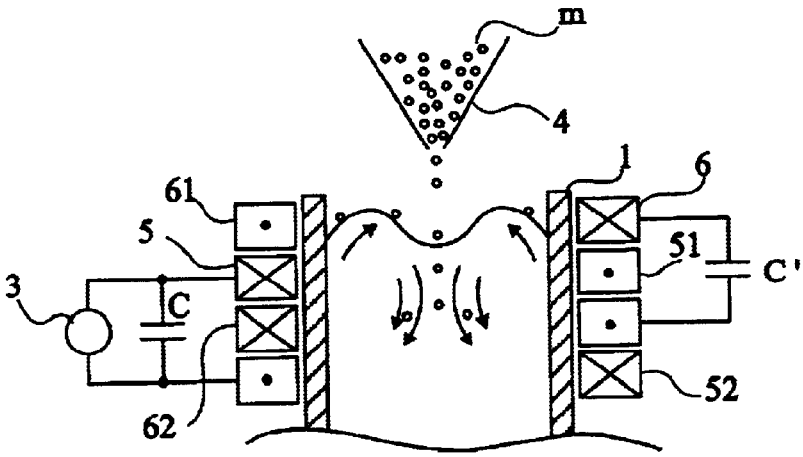
FIG. 2 schematically shows in a cross-section view an embodiment of an inductive stirring installation according to the present invention.

FIG. 2 schematically shows an embodiment of an inductive heating installation, for example, a continuous casting installation, according to the present invention. In the example of FIG. 2, the container is a cold crucible.

As previously, the installation is based on the use of a sectorized cold crucible 1, that is, a crucible including several vertical sectors cooled down, for example, by water circulation and which are assembled to one another to form a tubular structure. In FIG. 2, the crucible has been shown in cross-section view without showing the conventional cooling means for clarity.

A first winding 5 is wound around crucible 1 and is connected, by its two ends, across a single-phase A.C. generator 3 in parallel with a capacitor C. According to the present invention, winding 5 is formed of at least two coils 51 and 52 associated in series-opposition, that is, wound in opposite directions around crucible 1. Still according to the present invention, at least one second winding 6 is also wound around crucible 1 and is connected by its two ends across a capacitor C'. The second winding 6 includes, like the first winding 5, at least two coils 61, 63 associated in series-opposition.

Further, windings 5 and 6 are interwoven, that is, the coils are arranged successively along the crucible height to alternate a coil of the first winding with a coil of the second winding. Thus, in the example of a two-phase system such as shown in FIG. 2, one can find, from the top of crucible 1, first coil 61 of winding 6, first coil 51 of winding 5, second coil 62 of winding 6, and second coil 52 of winding 5.

According to the present invention, the second winding 6 plays the role of an induced circuit, the power of which canes from the first winding 5.

Figure 3:
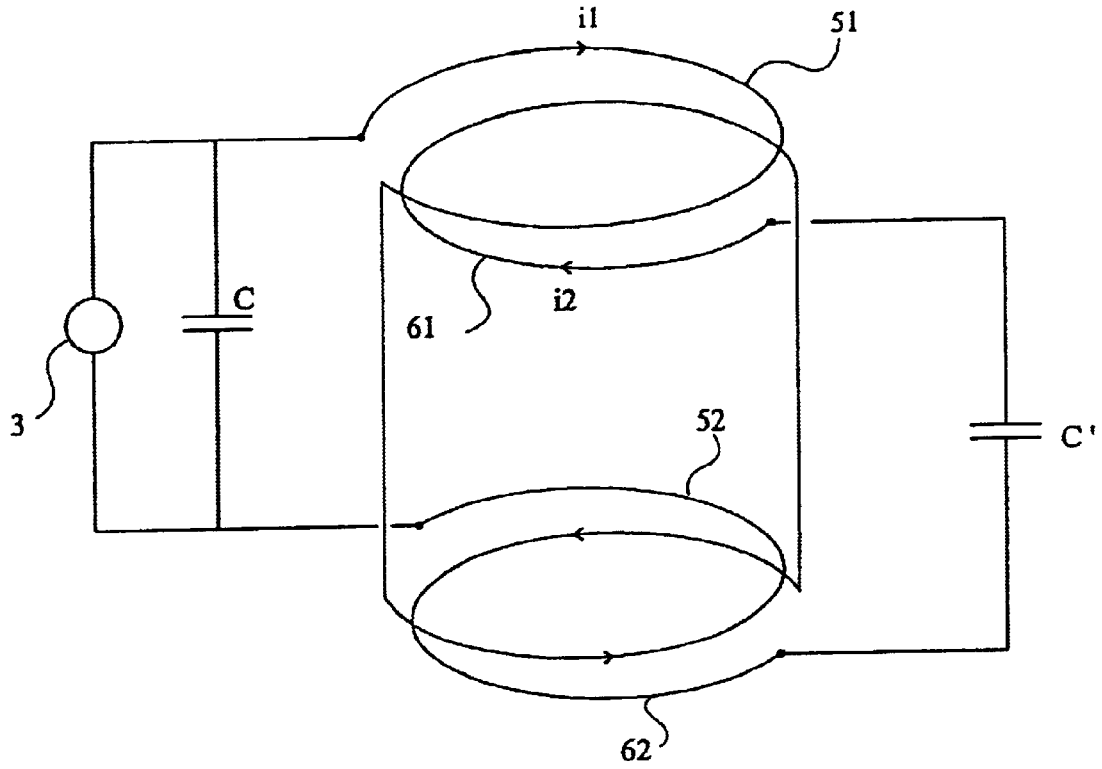
FIG. 3 schematically illustrates the electronic circuit of the installation of FIG. 2.

FIG. 3 shows the electric circuit of the installation of FIG. 2. This drawing shows the elements described in relation with FIG. 2 and illustrates in a perspective view the direction of the coils of windings 5 and 6 in series-opposition. It should be noted that, in FIG. 2, the current flow direction in the respective coils has been indicated with the notations (x, .) usual in electromagnetism.

Winding 5 forms, with capacitor C, a first oscillating circuit connected to generator 3 and forming a first excitation phase of the multiphase system. The second winding 6, spatially shifted with respect to the first winding 5 forms, with capacitor C', a second oscillating circuit. This second oscillating circuit is in magnetic interaction by its mutual inductance with the first oscillating circuit. The magnetic field resulting from the superposition of the two phases in presence can then be made, by sizing, to be a drift field likely to generate an electromagnetic motive pumping force on the induced metal contained in crucible 1.

The respective sizing of the windings and of the capacitors depends on the application and, in particular, on the frequency of generator 3, on the diameter of crucible 1, and on the desired skin depth in the metal. Preferably, the number of turns in the coils of a same winding is identical.

The system optimization according to the application is within the abilities of those skilled in the art, by implementing electric and electromagnetic operation rules based on the respective inductances, on the respective resistances, and on the respective capacitances of the oscillating circuits, and on the mutual inductance of the two circuits and on the frequency of the single-phase generator.

To obtain a linear drift field effect allowing the pumping effect at the container periphery, it will be desired, preferably, for products $LC\omega^2$ and $L'C'\omega^2$, where L and L' represent the respective inductances of windings 5 and 6 and where $\omega$ represents the angular frequency of the single-phase generator 3, to be as close as possible to unity to optimize the operation of the oscillating circuits.

An advantage of the present invention is that it enables inverting the melt stirring direction as illustrated by the arrows in FIG. 2, by means of a single-phase generator. Thus, in the case of a low frequency corresponding to the frequency of the A.C. supply network (50 or 60 hertz), it is now no longer necessary to have a multiphase power supply and an installation according to the present invention can be directly connected on a single-phase connection to the supply network. In the case of an installation requiring a medium frequency generation, the present invention has the advantage of only requiring a single single-phase generator, which considerably reduces the installation cost by reducing the number of necessary power switches.

Another advantage of the present invention is that the synchronization of the induced phase (phase obtained by the secondary winding) or of the induced phases in case several secondary windings are used, raises no specific problem.

Another advantage of the present invention is that the system is particularly stable once adapted to the application. Indeed, conversely to the use of several distinct generators to obtain a multiphase induction heating system, the elements (inductors and capacitors) used by the present invention to generate the additional phase(s) do not risk going wrong as could be the case for active elements (high-power switches).

Figure 4:
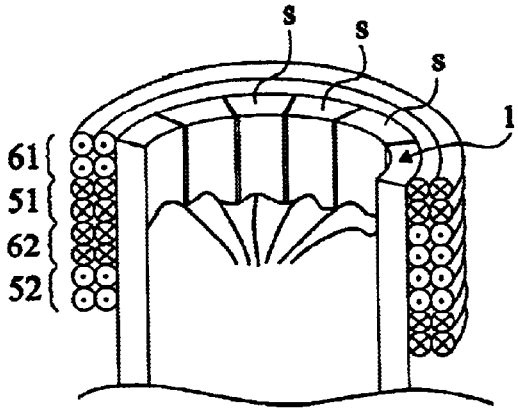
FIG. 4 is a partial perspective view of a cold inductive crucible according to the present invention in operation.

FIG. 4 is a perspective cross-section view illustrating the simplified structure of a cold inductive crucible according to the present invention. This drawing shows sectors s of crucible 1 which are electrically isolated from one another. In the example of FIG. 4, each coil 61, 51, 62, 52 includes four turns.

FIG. 3 shows that the number of stirring wheels of the molten metal depends on the number of sectors in the crucible. Thus, not only does the inversion of the stirring direction by means of a multiphase system according to the present invention favor the inclusion of particles at the melt center, but also, in this application, is the stirring favored by the sectorized structure of the crucible, which improves the mixing.

The stirring speeds depend on the intensity of currents i1 and i2, and thus on the intensity of the current provided by generator 3.

It should be noted that, according to the present invention, it is not necessary to have a 90° phase shift between the two oscillating circuits. A phase shift on the order of from 20 to 40° is sufficient in terms of efficiency for the stirring performed by the system of the present invention.

It should also be noted that the phase angle between the two oscillating circuits is adjustable by the respective values of the capacitors and inductors used. However, as previously indicated, this phase angle is stable once set by the sizing of these elements.

In practice, when the application relates to an inductive heating, the values required for the respective inductances of the windings will preferably be first set. These values indeed condition the heating of the molten metal. Account will however be taken, according to the present invention, of the existence of the induced phase, which also takes part in the heating.

The respective values of capacitors C and C' will then be set according to the frequency of the single-phase generator frequency and to the desired skin depth, which depends on the diameter of crucible 1. It should be noted that the respective ratios between the inductances of the windings and capacitances C and C' must be compatible with the output impedance of the single-phase generator 3.

As a specific example of implementation, for a crucible having a diameter on the order of ten centimeters and for a single-phase generator having an operating frequency on the order of twenty kHz, capacitors having values on the order of 20 $\mu$F may be used with windings having respective self inductances of 2 $\mu$H and having resistances on the order of thirty m$\Omega$. In such an example, a phase-shift on the order of 40° between currents i1 and i2 of the respective windings and a ratio of the current amplitudes on the order of 1.1 are obtained.

Of course, the present invention is likely to have various alterations and modifications which will readily occur to those skilled in the art. In particular, although the present invention has been described hereabove in relation with a two-phase system, it may also be implemented with more than two phases. On this regard, it should be noted that the higher the number of phases, the more the system is controllable, for example, to stir a greater height of molten metal. The adapting of the above-described system to a greater number of phases is within the abilities of those skilled in the art. It will however be ascertained to respect the interweaving of the different windings in the crucible height and the series-opposition associations of the coils forming the different windings.

Further, the choice of the number of turns per coil, of the number of turns per winding, and of the turn arrangement is within the abilities of those skilled in the art based on the indications given hereabove. In particular, the turn section will of course depend on the current intensity, and the arrangement in the crucible height will depend on the height thereof and on the number of coils. For example, referring to the embodiment described hereabove in relation with FIG. 4, the average level of the liquid metal will be chosen to approximately correspond to the middle of the height of first coil 51 of first winding 5. The increase in the number of coils in a same winding enables increasing (by cumulative effect due to the increase in the interaction height) the pumping strength, and thus the stirring efficiency.

What is claimed is:

1. An installation for processing by induction a metallic material comprising:

a first winding (5) including, in series, at least one first coil (51) of at least one turn and at least one second coil

(52) of at least one turn, wound in opposite directions around a container (1), the first winding having two end terminals connected to an A.C. supply source (3) and across at first capacitor (C); and at least one second winding (6) including, in series, at least one first coil (61) of at least one turn and at least one second coil (62) of at least one turn, wound in opposite directions around the container by being imbricated in the first winding (5), the ends of the second winding (6) being connected across a second capacitor (C').

2. The installation of claim 1, wherein the capacitances (C, C') depend on a-frequency (3) of said A.C. supply source and on the depth of an electromagnetic skin wanted inside the container (1).

3. The installation of claim 1 wherein said container is an inductive crucible and the combined inductances of the two windings (5, 6) being a function of a heating intensity desired inside the crucible (1).

4. The installation of claim 1, further comprising at least one third winding, two terminals of which are connected to a third capacitor, the third winding being formed of at least two coils associated in series-opposition.

5. The installation of claim 2, wherein said container is in an inductive crucible, wherein the combined inductances of the two windings (5, 6) being a function of the heating intensity desired inside the crucible (1).

6. The installation of claim 2, further comprising at least one third winding, two terminals of which are connected to a third capacitor, the third winding being formed of at least two coils associated in series-opposition.

7. The installation of claim 3, further comprising at least one third winding, two terminals of which are connected to a third capacitor, the third winding being formed of at least two coils associated in series-opposition.

* * * * *